US011091909B2

(12) United States Patent
Riiber et al.

(10) Patent No.: US 11,091,909 B2
(45) Date of Patent: Aug. 17, 2021

(54) BUILDING PANEL ADAPTED TO BE MOUNTED AT A CEILING OR WALL OF A ROOM AND METHOD OF MANUFACTURING SUCH BUILDING PANEL

(71) Applicant: KVADRAT SOFT CELLS A/S, Ebeltoft (DK)

(72) Inventors: Jacob Jørn Riiber, Virum (DK); Michael Toldam Korsgård, Copenhagen S (DK)

(73) Assignee: KVADRAT SOFT CELLS A/S, Ebeltoft (DK)

( * ) Notice: Subject to any disclaimer, the term of this patent is extended or adjusted under 35 U.S.C. 154(b) by 0 days.

(21) Appl. No.: 16/611,426

(22) PCT Filed: May 8, 2017

(86) PCT No.: PCT/IB2017/052669
§ 371 (c)(1),
(2) Date: Nov. 6, 2019

(87) PCT Pub. No.: WO2018/206998
PCT Pub. Date: Nov. 15, 2018

(65) Prior Publication Data

US 2020/0165820 A1 May 28, 2020

(51) Int. Cl.
*E04B 9/00* (2006.01)
*E04B 9/04* (2006.01)
(Continued)

(52) U.S. Cl.
CPC ..... *E04B 9/26* (2013.01); *E04B 9/045* (2013.01); *E04F 13/005* (2013.01); *E04B 9/001* (2013.01);
(Continued)

(58) Field of Classification Search
CPC ..... E04B 9/001; E04B 9/0428; E04B 9/0435; E04B 9/045; E04B 9/061; E04B 9/125;
(Continued)

(56) References Cited

U.S. PATENT DOCUMENTS 4,194,329 A * 3/1980 Wendt ..... E04B 1/8227 52/145
4,788,806 A * 12/1988 Sease ..... B44C 7/022 160/395
(Continued)

FOREIGN PATENT DOCUMENTS

CN 202787612 U 3/2013
CN 204876263 U 12/2015
(Continued)

OTHER PUBLICATIONS

European Patent Office, International Search Report in International Application No. PCT/IB2017/052669 (dated Feb. 6, 2018).
(Continued)

*Primary Examiner* — Ryan D Kwiecinski
(74) *Attorney, Agent, or Firm* — Neal, Gerber & Eisenberg LLP; Thomas E. Williams

(57) ABSTRACT

The building panel (1) is adapted to be mounted at a ceiling or wall of a room so that a framework (2) of the building panel has a room-facing side (3) and a building-facing side (4). A textile (5) is extended over the room-facing side (3) of the framework (2) and has a first surface (6) facing the framework (2) and a second surface (7) generally visible from said room. A mesh (8) is laminated onto the first surface (6) of the textile (5) and is attached to the framework (2) by means of a number of connectors (9). Each connector (9) has a first end (10) in the form of a gripper inserted between a part of the mesh (8) and the textile (5) and a second end (13) attached to the framework (2).

22 Claims, 8 Drawing Sheets

(51) Int. Cl.
*E04F 13/00* (2006.01)
*E04B 9/26* (2006.01)
*E04B 9/22* (2006.01)

(52) U.S. Cl.
CPC ..... *E04B 9/0428* (2013.01); *E04B 9/0435* (2013.01); *E04B 9/225* (2013.01); *E04B 2009/0492* (2013.01)

(58) Field of Classification Search
CPC ... E04B 9/24; E04B 9/245; E04B 9/26; E04B 9/3023; E04B 2009/0492; E04B 2103/04; E04F 13/002; E04F 13/005; E04F 13/0876
See application file for complete search history.

(56) References Cited

U.S. PATENT DOCUMENTS 5,832,685 A * 11/1998 Hermanson ..... E04B 9/001 52/506.07
5,970,669 A * 10/1999 Livingston ..... E04B 1/8409 160/327
6,487,822 B1 * 12/2002 Haack ..... E04B 9/0435 52/144
6,499,262 B1 * 12/2002 Pinchot ..... E04B 9/001 160/327
7,926,237 B2 * 4/2011 Gerkes ..... E04F 13/0812 52/506.03
8,316,607 B2 * 11/2012 Eisner ..... E04B 9/0478 52/506.09
9,745,748 B2 * 8/2017 Bergman ..... E04B 9/0428
10,273,696 B2 * 4/2019 Scherrer ..... E04B 9/303
10,711,465 B2 * 7/2020 Nielsen ..... E04F 13/0805
10,731,342 B2 * 8/2020 Nielsen ..... E04B 9/0428
2011/0252736 A1 10/2011 Bailey et al.
2020/0115897 A1 * 4/2020 Nielsen ..... D06M 11/83

FOREIGN PATENT DOCUMENTS

CN 205012488 U 2/2016
CN 205857498 U 1/2017
CN 205990693 U 3/2017
EP 0013513 A1 7/1980
EP 2444561 A1 4/2012
FR 2641810 A1 7/1990
FR 2712004 A1 * 5/1995 ..... E04B 9/001
JP 2014101715 A * 6/2014 ..... E04B 9/32
WO 2005/056899 A1 6/2005
WO WO 2005/073482 A2 8/2005
WO WO 2018/206998 A1 11/2018
WO WO-2019229157 A1 * 12/2019 ..... E04B 9/303

OTHER PUBLICATIONS

European Patent Office, Written Opinion of the International Searching Authority in Application No. PCT/IB2017/052669 (dated Feb. 6, 2018).
The China National Intellectual Property Administration, First Notification of Office Action in Chinese Application No. 201780090439X (dated Dec. 17, 2020) together with a partial English translation thereof (14 pages).

* cited by examiner

BUILDING PANEL ADAPTED TO BE MOUNTED AT A CEILING OR WALL OF A ROOM AND METHOD OF MANUFACTURING SUCH BUILDING PANEL

The present invention relates to a building panel adapted to be mounted at a ceiling or wall of a room so that a framework of the building panel has a room-facing side and a building-facing side, wherein a textile is extended over the room-facing side of the framework, the textile having a first surface facing the framework and a second surface generally visible from said room.

Such building panels can generally be used to cover interior surfaces in buildings, for instance in auditoriums, open-plan offices, etc. In such fields as architecture and interior design there is often a need for panels for covering of boundaries of a room, such as the ceiling, the walls or partitions placed within the room. Such panels can serve purely aesthetic purposes but can also be used to actively alter a room's characteristics, for instance relating to acoustic and thermal properties of the room.

WO 2005/073482 A2 discloses a system of building panels for suspended ceilings. Each building panel includes a frame composed by profile members, and a room-facing side of the building panel is formed by a textile suspended between the profile members. Different tensioning systems are disclosed whereby the textile may be stretched evenly over the opening of the frame and thereby form a smooth flat surface visible from the room. However, whereas the building panels disclosed are excellent when a smooth flat textile surface is desired, these building panels are generally not suitable if a curved textile surface is required. On the other hand, if these building panels are required to be relatively large, a correspondingly large tensioning force is necessary in order to maintain the textile appropriately stretched, and in the case of very large building panels, the weight of the textile would inevitably weigh down the textile in the central area of the frame, and it would be impossible to achieve a flat textile surface.

In the fields of architecture and interior design, curved and/or very large building panels may be required for different reasons, such as for aesthetic or practical purposes.

The object of the present invention is to provide a building panel suitable for extending flat or smoothly curved textile surfaces of any desired size.

In view of this object, a mesh is laminated onto the first surface of the textile, the mesh is attached to the framework by means of a number of connectors, and each connector has a first end in the form of a gripper inserted between a part of the mesh and the textile and a second end attached to the framework.

Thereby the mesh and the textile laminated with the mesh may at suitable points be attached to the framework in order for the mesh and textile to follow the surface contour of the framework whether the surface contour is flat, concave or convex. The framework may have any desired size, because an increased weight of the textile may be carried by a correspondingly increased number of connectors. Because the gripper forming the first end of the connectors is inserted between a part of the mesh and the textile, the gripper is not visible from the room.

In an embodiment, the first and second ends of each connector are mutually connected by means of a tensioned spring. Thereby, by adapting the spring constant of the spring, the mesh and textile may in an even better way smoothly follow the surface contour of the framework.

In an embodiment, each connector has the form of a tension coil spring having a first end which is formed integrally with a first hook forming the gripper at the first end of the connector and having a second end which is formed integrally with a second hook at the second end of the connector, and the second hook is attached to the framework. Thereby, a standard tension coil spring having a first and a second hook formed by the respective ends of the spring coil may be used to form the connector.

In an embodiment, the mesh is formed from a resilient material, and the mesh, when it is in its relaxed state, before being attached to the framework, forms a flat surface. Thereby, the mesh and textile may in an even better way smoothly follow the surface contour of the framework without forming bends or creases possibly revealing parts of the framework on the second surface of the textile.

In an embodiment, the stiffness of the mesh is adapted to the stiffness of and the areal weight of the textile so that the second surface of the textile extends in a smooth and even manner Thereby, the mesh and textile may in an even better way smoothly follow the surface contour of the framework.

In an embodiment, the mesh has been laminated onto the first surface of the textile by means of adhesive, and the adhesive does not cover or covers only part of the textile covered by the mesh openings. Thereby, it may be avoided that pores of the textile are clogged by the adhesive and it may therefore be possible to balance the acoustic and thermal comfort of a building by means of the building panel.

In an embodiment, the mesh has been laminated onto the first surface of the textile by means of heat lamination, and a heat activated adhesive in the form of a slit film net or web has been arranged between the mesh and the textile. Thereby, the lamination of the mesh onto the textile may be facilitated and it may by means of the slit film net or web be ensured that the adhesive does not cover or covers only part of the textile covered by the mesh openings. Consequently, as also mentioned above, it may be avoided that pores of the textile are dogged by the adhesive and it may therefore be possible to balance the acoustic and thermal comfort of a building by means of the building panel.

In an embodiment, the room-facing side of the framework includes at least one concave area, and wherein, at each concave area of the room-facing side of the framework, the mesh is attached to the framework by means of at least one connector. Thereby, building panels having a variety of curved surfaces may be provided wherein it may be ensured that the mesh and textile smoothly follow the surface contour of the framework. In the concave areas of the room-facing side of the framework, the at least one connector may ensure that the mesh and textile smoothly follow the surface contour of the framework, and in flat or convex areas of the room-facing side of the framework, the mesh and textile may also smoothly follow the surface contour of the framework, at least because the mesh may be attached to the framework by means of connectors in surrounding concave areas of the room-facing side of the framework.

In an embodiment, the second surface of the textile includes at least one concave area and at least one convex area, and at least at each concave area of the second surface of the textile, the mesh is attached to the framework by means of at least one connector.

In a structurally particularly advantageous embodiment, the framework includes a number of criss-crossed beams at least substantially forming a surface contour followed by the laminate of the mesh and textile. Thereby, the mesh may ensure that the textile smoothly follows the surface contour of the framework also in areas formed between the criss-crossed beams.

In a structurally particularly advantageous embodiment, each beam is provided with a number of fixation cutouts which are mutually spaced in the longitudinal direction of the beam and which the second end of a connector may engage for connection with the beam. Thereby, connectors may easily be arranged at suitable positions when assembling the building panel, and it may thereby by visual feedback be ensured that the textile actually smoothly follows the surface contour of the framework. By means of the fixation cutouts, the connectors may easily be brought into engagement with the framework without the need for additional elements.

In a structurally particularly advantageous embodiment, at each fixation cutout, a connector cutout is formed in an edge of the beam, said edge supporting the laminate of the mesh and textile, and the connector cutout is adapted to receive a connector attaching the mesh to the framework. Thereby, each connector may freely extend between the fixation cutout and the mesh, and it may thereby be ensured that the connector is free to tension the mesh and textile in a suitable manner so that the mesh and textile smoothly follow the surface contour of the framework.

In an embodiment, the framework is surrounded by a frame composed by profile members, each profile member has a rounded outer edge connecting a room-facing side of the profile member with a building-facing side of the profile member, the textile is bent about the rounded outer edges of the profile members, and an edge part of the textile is fixed to the building-facing side of the profile members. Thereby, it may ensured that the edges of the building panel are smooth and only the textile is visible.

In an embodiment, the edge part of the textile that is bent about the rounded outer edges of the profile members is not laminated with the mesh, so that a border of the mesh is located next to the room-facing side of the profile member. Thereby, it may be ensured that the textile smoothly follows the rounded outer edges of the profile members independently of the stiffness of the mesh. In order to ensure that the mesh and textile smoothly follows the surface contour of the framework, it may be preferred that the mesh is rather stiff, and in this case, it may be especially advantageous when the part of the textile that is bent about the rounded outer edges of the profile members is not laminated with the mesh, as otherwise, it could be difficult or even impossible to ensure that the textile smoothly follows the rounded outer edges of the profile members.

The present invention further relates to a method of manufacturing a building panel adapted to be mounted at a ceiling or wall of a room so that a framework of the building panel has a room-facing side and a building-facing side, whereby a textile is extended over the room-facing side of the framework, the textile having a first surface facing the framework and a second surface generally visible from said room.

The method is characterised by that, before extending the textile over the room-facing side of the framework, a mesh is laminated onto the first surface of the textile, by that, after extending the textile over the room-facing side of the framework, the mesh is attached to the framework by means of a number of connectors, and by that each connector has a first end in the form of a gripper which is inserted between a part of the mesh and the textile and a second end which is attached to the framework. Thereby, the above described features may be obtained.

In an embodiment, the first and second ends of each connector are mutually connected by means of respective springs which are tensioned by the attachment of the mesh to the framework by means of the connectors. Thereby, the above described features may be obtained.

In an embodiment, the mesh is being laminated onto the first surface of the textile by means of adhesive so that the adhesive does not cover or covers only part of the textile being covered by the mesh openings. Thereby, the above described features may be obtained.

In an embodiment, the mesh is being laminated onto the first surface of the textile by means of heat lamination, and a heat activated adhesive in the form of a slit film net or web is being arranged between the mesh and the textile. Thereby, the above described features may be obtained.

In an embodiment, the room-facing side of the framework includes at least one concave area, and whereby, at each concave area of the room-facing side of the framework, the mesh is being attached to the framework by means of at least one connector. Thereby, the above described features may be obtained.

In an embodiment, the framework includes a number of criss-crossed beams at least substantially forming a surface contour to be followed by the laminate of the mesh and textile, each beam is provided with a number of fixation cutouts which are mutually spaced in the longitudinal direction of the beam, and the second end of each connector is brought into engagement with a respective fixation cutout for connection with the beam. Thereby, the above described features may be obtained.

In an embodiment, at each fixation cutout, a connector cutout is formed in an edge of the beam, the laminate of the mesh and textile is arranged so that it is supported by said edge, and each connector is arranged in a respective connector cutout in order to attach the mesh to the framework. Thereby, the above described features may be obtained.

In an embodiment, the framework is surrounded by a frame composed by profile members, each profile member has a rounded outer edge connecting a room-facing side of the profile member with a building-facing side of the profile member, and the textile is bent about the rounded outer edges of the profile members, and an edge part of the textile is fixed to the building-facing side of the profile members. Thereby, the above described features may be obtained.

Preferably, the textile is bent about the rounded outer edges of the profile members and fixed to the building-facing side of the profile members after attaching the mesh to the framework by means of the connectors. Thereby, it may be ensured that the dimensions of the mesh and textile in all directions fit the surface contour of the framework before the edge parts of the textile are fixed to the building-facing side of the profile members. Thereby, the mesh and textile may smoothly follow the surface contour of the framework and the textile may fit the rounded outer edges of the profile members without forming bends or creases.

In an embodiment, before bending the textile about the rounded outer edges of the profile members, an edge part of the textile that has to be bent about said rounded outer edges is delaminated from the mesh, and the delaminated edge part of the mesh is cut off, so that a border of the mesh is located next to the room-facing side of the profile members, when the edge part of the textile has been bent about said rounded outer edges and has been fixed to the building-facing side of the profile members. Thereby, the above described features may be obtained. Furthermore, the dimensions of the mesh and the textile may be adapted to the framework and the rounded outer edges of the profile members during mounting of the mesh and textile on the framework, whereby correct dimensions may be ensured in an easy way.

The invention will now be explained in more detail below by means of examples of embodiments with reference to the very schematic drawing, in which FIG. 1 is a cross-sectional view through part of an embodiment of a building panel according to the invention;

Figure 1:
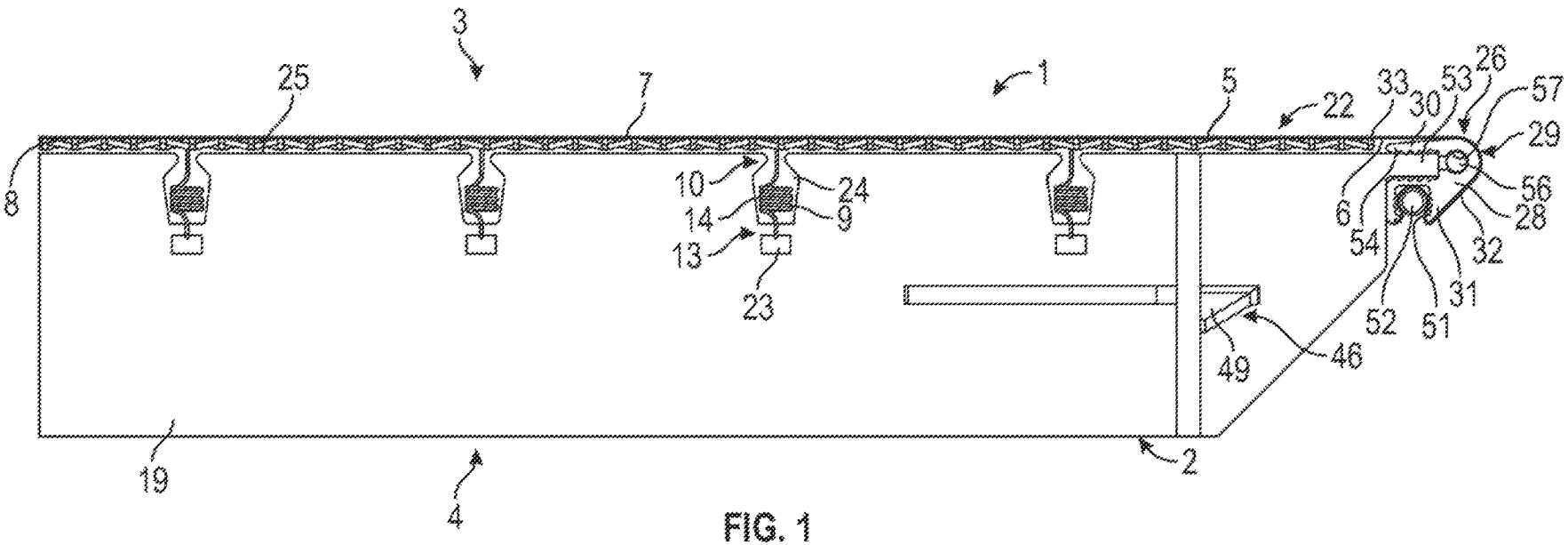
Figure 2:
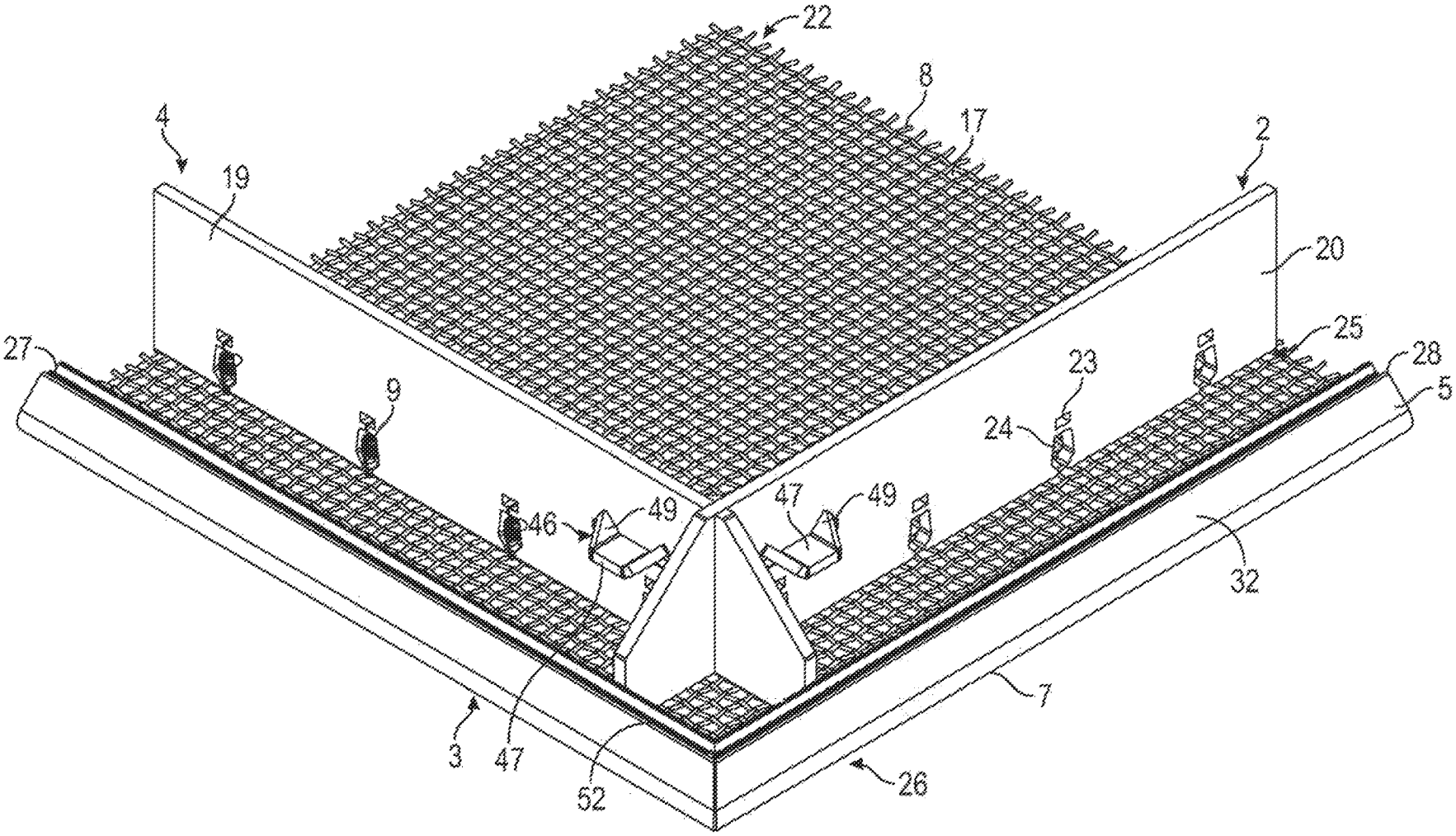
FIG. 2 is a perspective view seen from above of the part of a building panel of FIG. 1.

FIG. 1 shows part of an embodiment of a building panel 1 according to the invention, adapted to be mounted at a not shown ceiling or wall of a room. In its mounted state in the room, the building panel 1 has a framework 2 with a room-facing side 3 and a building-facing side 4. It is noted that in FIG. 1, the building panel 1 is illustrated upside down compared to its mounting position when mounted at a ceiling. In FIG. 2, which is a perspective view seen from above of the part of a building panel of FIG. 1, the panel 1 is illustrated in its correct mounting position when mounted at a ceiling. The framework 2 of the panel 1 may be mounted to a ceiling or wall by means of not shown, conventional means, such as brackets, wires or the like. The framework 2 may be provided with sound-absorbing elements, for instance mats of mineral wool.

A textile 5 is extended over the room-facing side 3 of the framework 2, and the textile 5 has a first surface 6 facing the framework 2 and a second surface 7 generally visible from the room when the panel is mounted at a wall or ceiling of the room. Furthermore, before extending the textile 5 over the room-facing side 3 of the framework 2, a mesh 8 has been laminated onto the first surface 6 of the textile 5. The mesh 8 is attached to the framework 2 by means of a number of connectors 9, one of which is illustrated in more detail in FIG. 7. Each connector 9 has a first end 10 in the form of a gripper 11 inserted between a part 12 of the mesh 8 and the textile 5 and a second end 13 attached to the framework 2. As it is seen, the first and second ends 10, 13 of each connector 9 are mutually connected by means of spring 14 which is tensioned in its mounted state.

In the illustrated embodiment, each connector 9 has the form of a standard tension coil spring 15 having a first end which is formed integrally with a first hook 34 forming the gripper 11 at the first end 10 of the connector 9 and having a second end which is formed integrally with a second hook 35 at the second end 13 of the connector 9, and the second hook 35 is attached to the framework 2. Thereby, preferably, a commercially readily available standard tension coil spring having a first and a second hook formed by the respective ends of the metal thread or wire forming the spring coil may be used to form the connector 9.

Preferably, the mesh 8 is formed from a resilient material, and when the mesh 8 is in its relaxed state, before being attached to the framework 2, it preferably forms a flat surface. Thereby, the mesh 8 and textile 5 may in an even better way smoothly follow the surface contour of the framework 2 without forming bends or creases possibly rendering parts of the framework visible from the second surface 7 of the textile 5. The stiffness of the mesh 8 may advantageously be adapted to the stiffness of and the areal weight of the textile 5 in order to ensure that the second surface 7 of the textile 5 extends in a smooth and even manner.

The mesh 8 may for instance be made of a plastic material, such as polyester, but any material suitable in terms of mainly stiffness and areal weight may be employed, such as for instance metal. In an advantageous embodiment, the mesh 8 may be formed as a monofilament polyester mesh.

If the mesh 8 is formed as a monofilament mesh, the monofilament may have a diameter of for instance from about 0.1 millimetres to about 3.0 millimetres, and preferably from about 0.5 millimetres to about 2.0 millimetres.

Independently of the monofilament or wire diameter, the mesh 8 may for instance have a minimum opening or space cloth of from about 1.0 millimetres to about 20 millimetres, preferably from about 1.0 millimetres to about 10 millimetres, and most preferred from about 3.0 millimetres to about 7 millimetres. The opening or space cloth is defined as the distance between adjacent parallel monofilaments or wires.

The textile 5 extended over the room-facing side 3 of the framework 2 may be a nonwoven or woven fabric in the form of a flexible material formed by natural or artificial fibres, yarn or thread. The textile 9 is preferably of a material or structure that allows air to diffuse through it.

Figure 5:
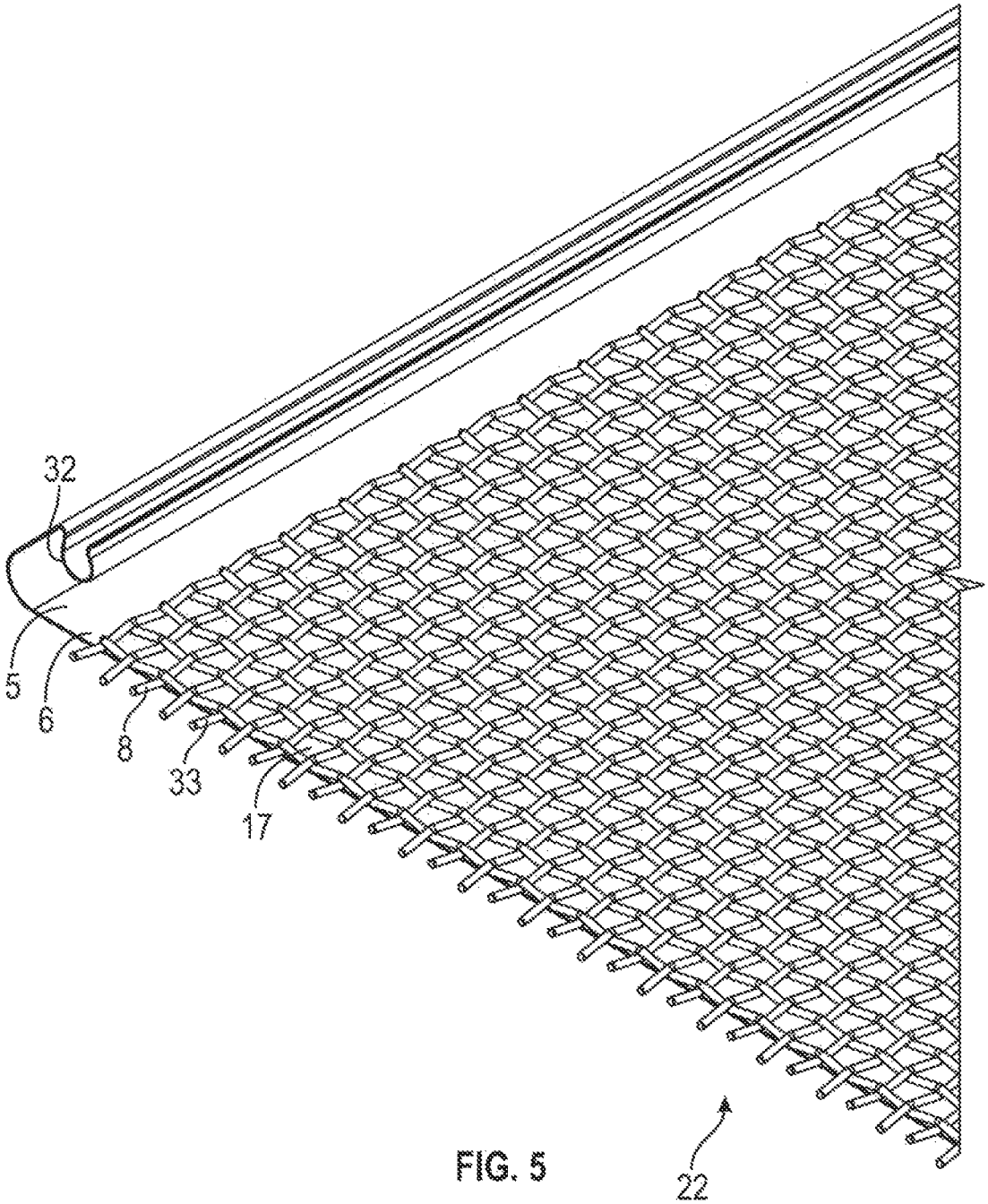
FIG. 5 is a perspective view seen from above of a part of a laminate of mesh and textile of a building panel according to the invention.

Preferably, the mesh 8 has been laminated onto the first surface 6 of the textile 5 by means of an adhesive 16 in such a way that the adhesive 16 does not cover or covers only part of the textile 5 covered by the mesh openings 17. The mesh openings 17 are best visible in FIG. 5. Thereby, it may be avoided that pores of the textile 5 are dogged by the adhesive 16 and it may therefore be possible to balance the acoustic and thermal comfort of a building by means of the building panel 1.

Figure 8:
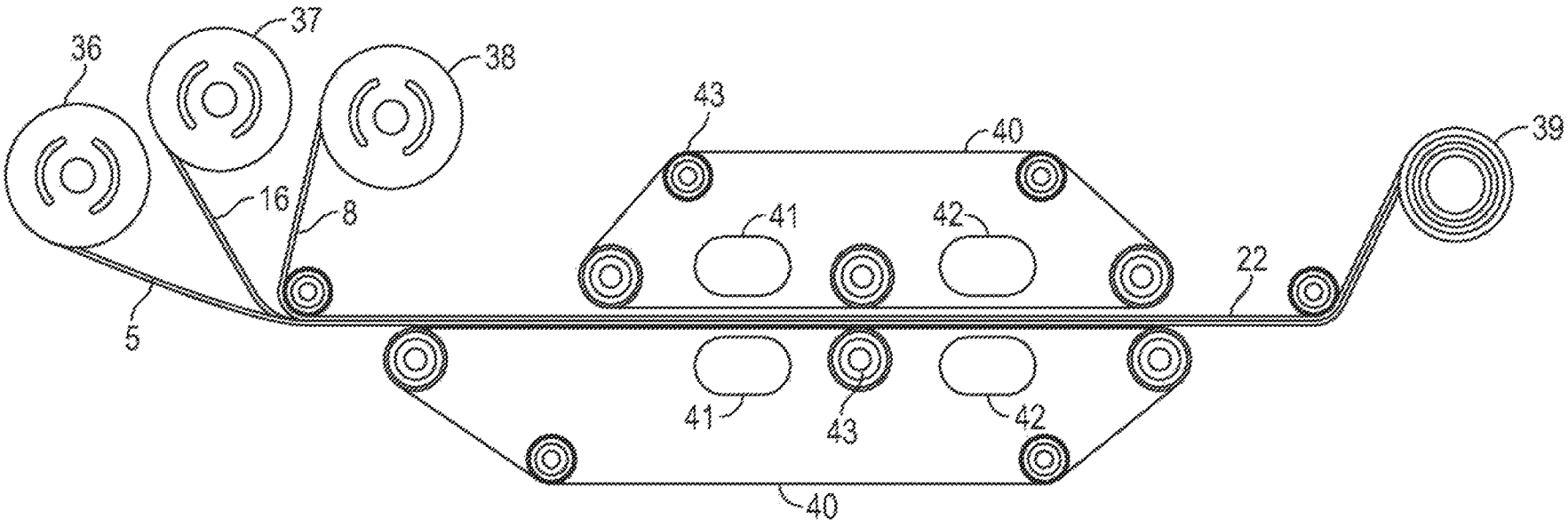
FIG. 8 illustrates a process of lamination of mesh and textile for a building panel according to the invention.

FIG. 8 schematically illustrates a preferred process of lamination of mesh 8 and textile 5 for a building panel 1 according to the invention. To the left in the figure is seen a roll 36 of textile 5, a roll 37 of heat activated adhesive 16 in the form of a slit film net or web and a roll 38 of mesh 8. To the right in the figure is seen a roll 39 of finished laminate 22 of mesh 8 and textile 5. During the lamination process, the layers of textile 5, adhesive 16 and mesh 8 are pressed against each other by means of endless pressure blankets 40. The heat activated adhesive 16 is activated by means of heating elements 41, and subsequently, the laminate is cooled down by means of cooling elements 42 before being rolled up on the roller 39. As mentioned, the heat activated adhesive 16 has the form of a slit film net or web which means that slits have been formed in the adhesive film, thereby forming openings which may ensure that the adhesive 16 does not cover or covers only part of the textile 5 covered by the mesh openings 17. Consequently, as also mentioned above, it may be avoided that pores of the textile are clogged by the adhesive and it may therefore be possible to balance the acoustic and thermal comfort of a building by means of the building panel 1. Of course, various other processes of lamination of mesh 8 and textile 5 are possible. For instance, instead of employing the pressure blankets 40, heated pressure rollers directly in contact with the laminate may be used.

Figure 3:
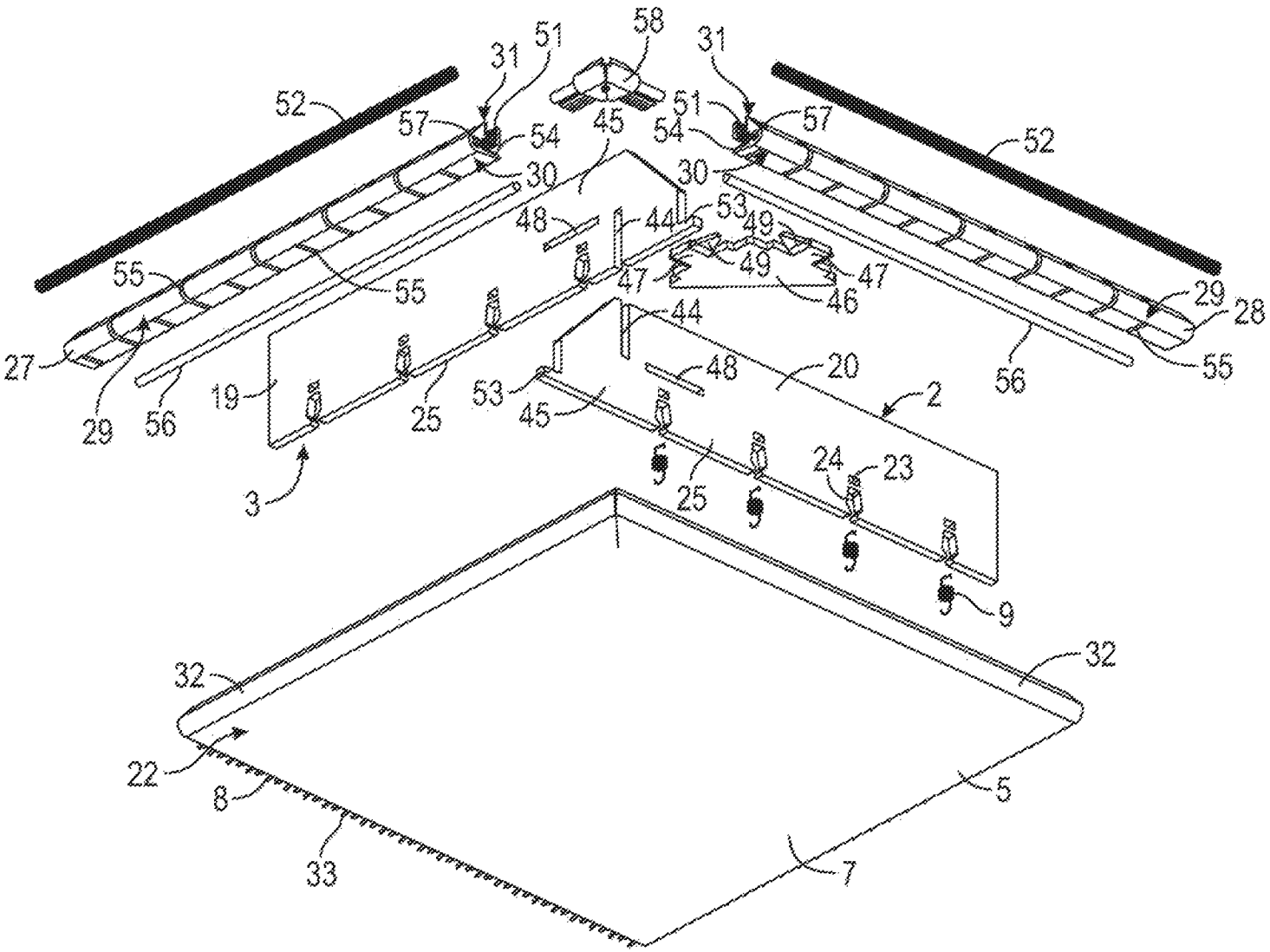
FIG. 3 is an exploded view seen from below of the part of a building panel of FIG. 1.
Figure 4:
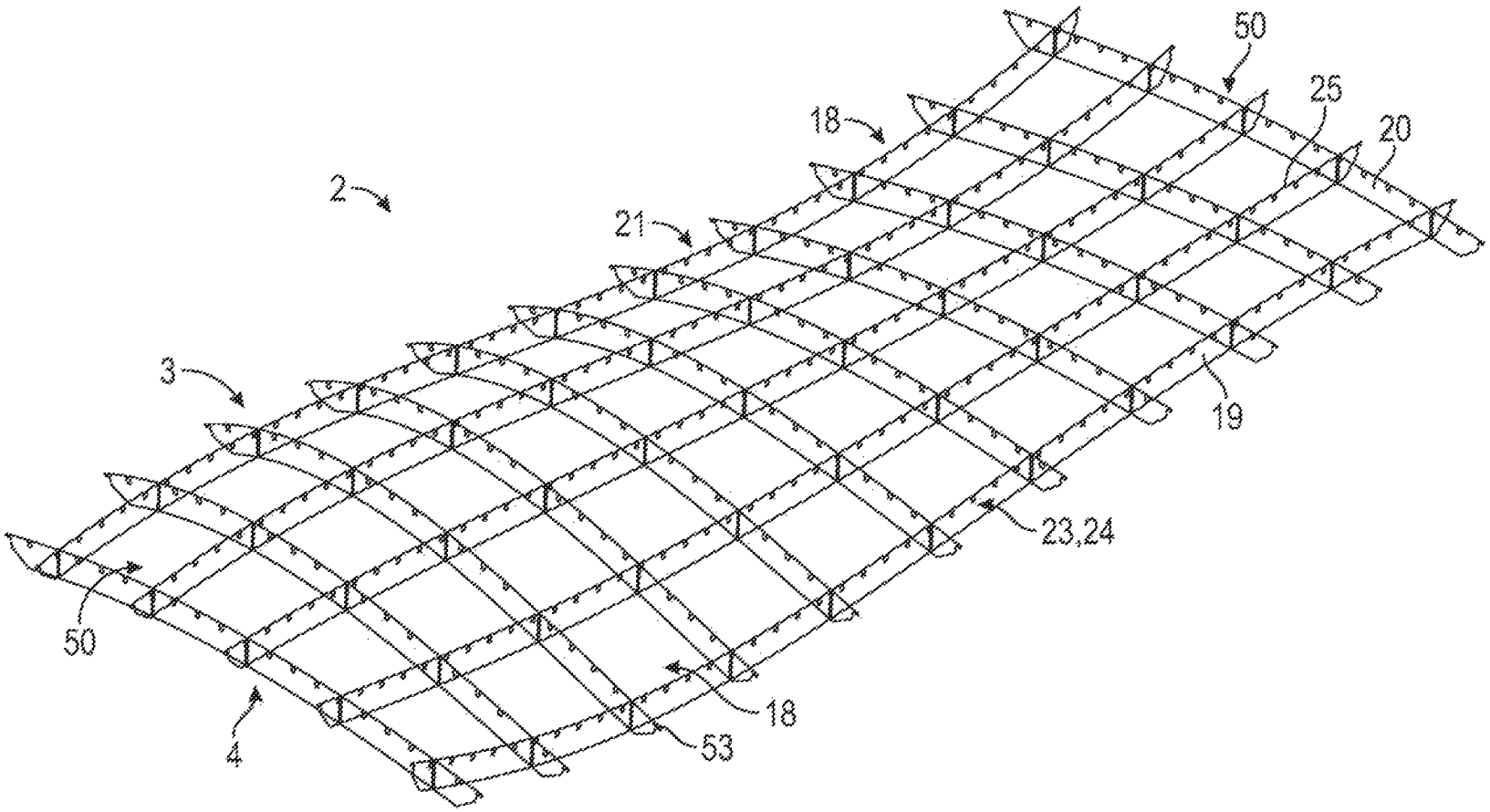
FIG. 4 is a perspective view of a room-facing side of a framework of a building panel according to the invention.

As illustrated in FIG. 4, the framework 2 includes a number of criss-crossed beams 19, 20 at least substantially forming a surface contour 21 to be followed by the laminate 22 of the mesh 8 and textile 5. The beams 19, 20 are preferably made of metal, such as aluminium. In the embodiment shown, the beams 19, 20 are arranged at right angles to each other, but the angle between the criss-crossed beams 19, 20 may differ from 90 degrees. For instance, the angle could be about 45, 70 or 80 degrees. As further seen in FIG. 3, beams 19, 20 arranged at right angles to each other are mutually connected in that the beams 19, 20 are provided with respective corresponding slits 44 extending at least approximately halfway laterally through the beams 19, 20 from respectively the room-facing side 3 of framework 2 and the building-facing side 4 of framework 2. Thereby, in a manner known per se, at corresponding slits 44 of two beams 19, 20 arranged at right angles to each other, the remaining part 45 of the beam 19, 20 in the lateral direction not cut through by the slit may engage with the corresponding slit of the other beam 19, 20, and vice versa.

Furthermore, in the embodiment shown, in order to strengthen the connection between two beams 19, 20 arranged at right angles to each other, a connection piece 46 is arranged at the connection between the two beams 19, 20. Such a connection piece 46 may be arranged at all the connections between angled beams 19, 20, or just at some connections. Preferably, at least at the corner connections of the framework 2, connection pieces 46 are arranged, as it is seen in FIGS. 2 and 3. The connection piece 46 is provided with two locking tabs 47 arranged at right angles in respect to each other and fitting into corresponding locking slits 48 in the respective two beams 19, 20. As seen in FIG. 2, a preferably tapered part 49 of each locking tab 47 may in a manner known per se be bent in relation to the remaining part of the locking tab 47 when the locking tab 47 has been inserted through the corresponding locking slit 48, thereby locking the locking tab 47 in the locking slit.

As it may further be seen in FIG. 4, the room-facing side 3 of the framework 2 forms the surface contour 21 to be followed at least substantially by the laminate 22 of the mesh 8 and textile 5. In the embodiment illustrated, the room-facing side 3 of the framework 2 includes at least two concave areas 18 and at least two convex areas 50 and may therefore be said to have double curvature or a compound curvature. According to the present invention, it is preferred that the mesh 8 is attached to the framework 2 by means of at least one connector 9 arranged at least in each concave area 18 of the room-facing side 3 of the framework 2. If the textile 5 is simply extended between the peripheral edges of the framework 2 in a manner known per se and as described in the following and without providing any connectors 9 between the mesh 8 and the framework 2, the mesh 8 and textile 5 will generally smoothly follow the convex areas 50 or any flat areas of the room-facing side 3 of the framework 2, provided that the textile 5 is not relatively too heavy, but the mesh 8 and textile 5 will generally not contact or follow the concave areas 18 of the room-facing side 3 of the framework 2. Therefore, according to the present invention, it is preferred that the mesh 8 is attached to the framework 2 by means of at least one connector 9 arranged at least in each concave area 18 of the room-facing side 3 of the framework 2. Thereby, provided that the textile 5 is not relatively too heavy, it may generally be ensured that the mesh 8 and textile 5 follow any concave areas 18, convex areas and flat areas of the room-facing side 3 of the framework 2. Nevertheless, for instance in the case that the textile 5 and/or the mesh 8 is/are relatively heavy, in order to even better ensure that the mesh 8 and textile 5 smoothly follow the surface contour 21 of the framework 2, it may be preferred that at least one connector 9 is arranged also in any convex areas 18 or any flat areas of the room-facing side 3 of the framework 2.

It should be noted that, as explained above, the present invention is especially advantageous when the room-facing side 3 of the framework 2 has a double curvature or a compound curvature; however, the invention is equally applicable when the room-facing side 3 is flat or just convex, just concave or any combination thereof, because the connectors 9 may in any case be employed in order to even better ensure that the mesh 8 and textile 5 follow the room-facing side 3 of the framework 2.

Figure 6:
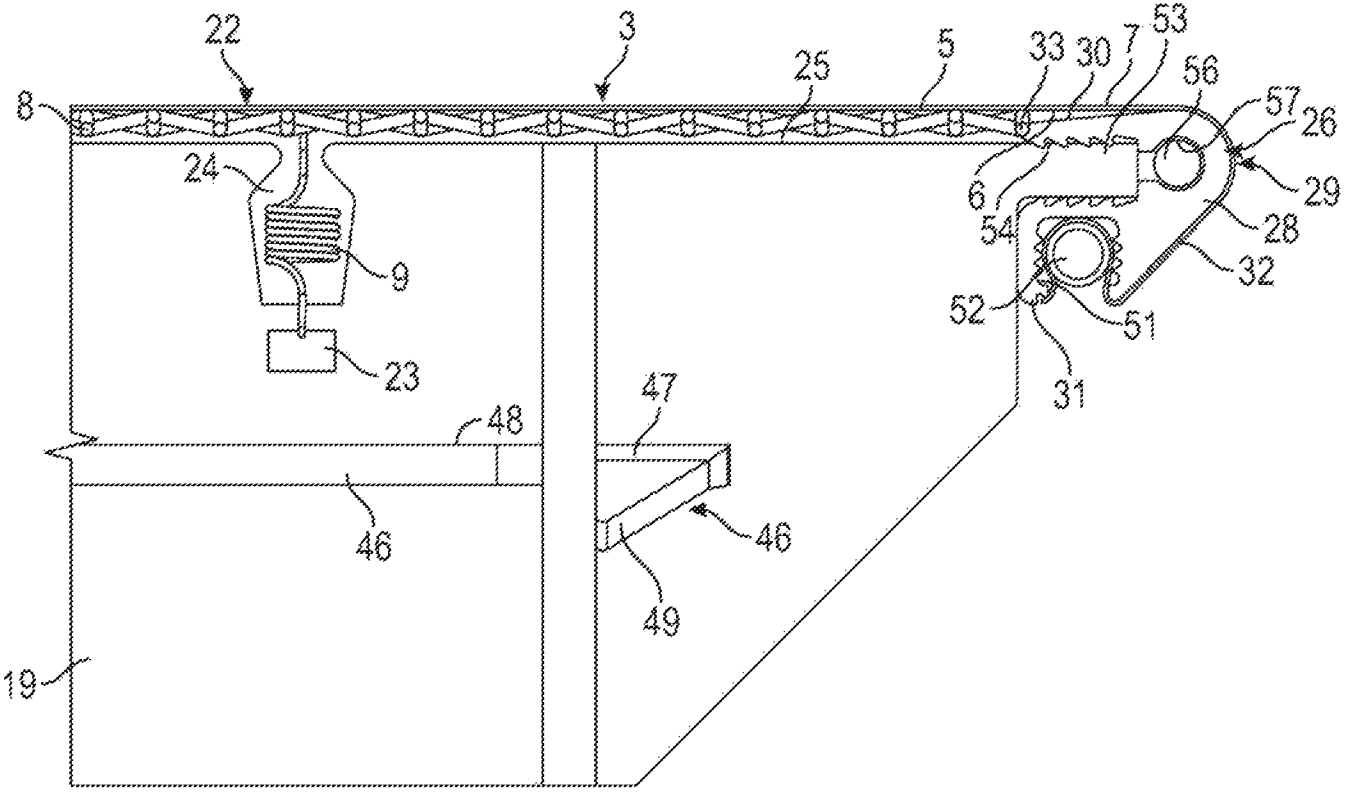
FIG. 6 illustrates on a larger scale a part of the building panel of FIG. 1.
Figure 7:
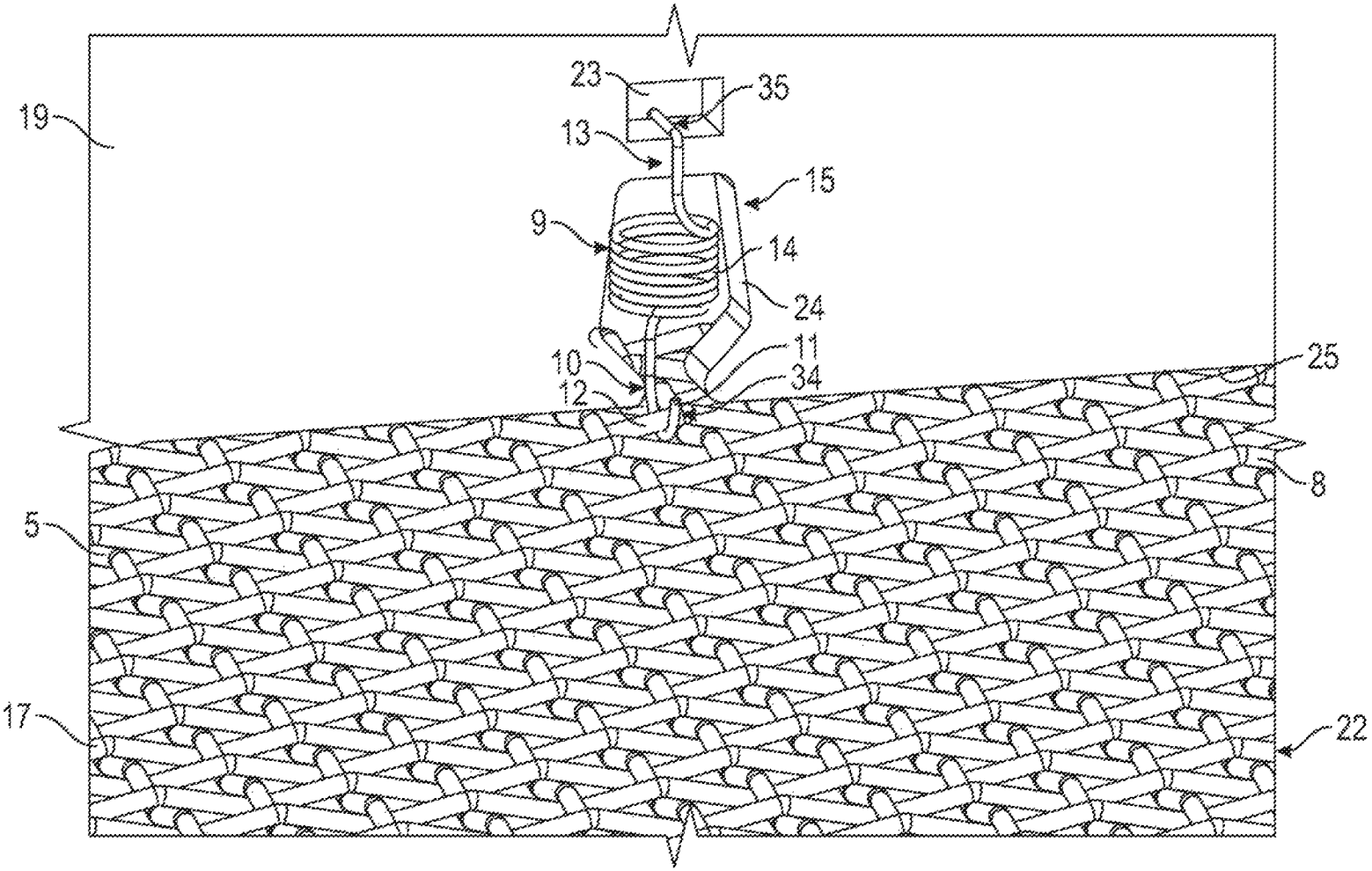
FIG. 7 is a perspective view on a larger scale, seen from above, of a detail of the building panel of FIG. 1.

As indicated in FIG. 4 and best visible in FIGS. 6 and 7, each beam 19, 20 is provided with a number of fixation cutouts 23 which are mutually spaced in the longitudinal direction of the respective beams 19, 20. The second end 13 of a connector 9 may thereby engage any fixation cutout 23 for connection with the respective beam 19, 20. Thereby, connectors 9 may easily be arranged at suitable positions when assembling the building panel 1, and it may thereby by visual feedback be ensured that the textile 5 actually smoothly follows the surface contour 21 of the framework 2. By means of the fixation cutouts 23, the connectors 9 may easily be brought into engagement with the framework 2 without the need for any additional elements.

Furthermore, as also best visible in FIGS. 6 and 7, it is preferred that at each fixation cutout 23, a connector cutout 24 is formed in an edge 25 of the beam 19, 20. Said edge 25 is adapted to support the laminate 22 of the mesh 8 and textile 5, and the connector cutout 24 is adapted to receive a connector 9 attaching the mesh 8 to the framework 2. Thereby, each connector 9 may freely extend between the fixation cutout 23 and the mesh 8, and it may thereby be ensured that the connector 9 is free to tension the mesh 8 and textile 5 in a suitable manner so that the mesh 8 and textile 5 smoothly follow the surface contour of the framework. The connector cutouts 24 may have any form and size suitable to receive a connector 9 without negatively affecting the tensioning function of the connector 9.

As illustrated in FIGS. 1 to 3, the framework 2 is preferably surrounded by a frame 26 composed by profile members 27, 28, preferably made of metal, such as aluminium. Each profile member 27, 28 has a rounded outer edge 29 connecting a room-facing side 30 of the profile member 27, 28 with a building-facing side 31 of the profile member 27, 28, and an edge part 32 of the textile 5 is bent about the rounded outer edges 29 of the profile members 27, 28 and fixed to the building-facing side 31 of the profile members 27, 28. In the building-facing side 31 of each profile member 27, 28 a serrated track 51 extends longitudinally in the profile member 27, 28 and a retaining member 52 in the form of a spring is pressed into the serrated track 51, thereby pinching a part of the edge part 32 of the textile 5 against the serrated walls of the serrated track 51 so that the edge part 32 of the textile 5 is fixed to the building-facing side 31 of the profile member 27, 28. Thereby, it may ensured that the edges of the building panel are smooth and only the textile is visible.

Each profile member 27, 28 is mounted on the framework 2 in that each end of the beams 19, 20 forming the framework 2 is provided with a tab 53 inserted into a serrated track 54 of the respective profile member 27, 28. As seen in FIG. 3, the profile members 27, 28 which are preferably made as extruded metal profiles, for instance made of aluminium, are provided with a number of lateral slits 55 spaced from each other in the longitudinal direction of the respective profile members 27, 28. Each lateral slit 55 extends only partly through the respective profile member 27, 28 in order to make the profile member flexible and bendable so that it may follow a possible curved contour of the corresponding edge of the framework 2, please refer to FIG. 4. In the embodiment illustrated, each second lateral slit 55 extends through a larger part of the cross-section of the respective profile member 27, 28 than its neighbouring lateral slit 55. Furthermore, in order to compensate for the flexibility of the profile members 27, 28 provided with lateral slits 55, in their mounted state on the framework 2, a rod 56 formed from spring steal is inserted into a partly open rounded channel 57 located in the profile members 27, 28, which are provided with lateral slits 55, at the bottom of the serrated track 54 of the profile member 27, 28. In this way, a mass produced extruded profile member 27, 28 may easily be formed to any desired curvature of an actual framework 2 of a building panel 1.

Preferably, the edge part 32 of the textile 5 that is bent about the rounded outer edges 29 of the profile members 27, 28 is not laminated with the mesh 28, so that a border 33 of the mesh 8 is located next to the room-facing side 30 of the profile members. This may preferably be achieved by that, before bending the textile 5 about the rounded outer edges 29 of the profile members 27, 28, an edge part 32 of the textile 5 that has to be bent about said rounded outer edges 29 is delaminated from the mesh 8, and the delaminated edge part of the mesh 8 is cut off, so that the border 33 of the mesh 8 is located next to the room-facing side 30 of the profile members 27, 28, when the edge part 32 of the textile 5 has been bent about said rounded outer edges 29 and has been fixed to the building-facing side 31 of the profile members 27, 28.

When, as explained just above, the edge part 32 of the textile 5 that is bent about the rounded outer edges 29 of the profile members 27, 28 is not laminated with the mesh 28, it may be ensured that the textile 5 smoothly follows the rounded outer edges 29 of the profile members 27, 28 independently of the stiffness of the mesh 8. In order to ensure that the mesh 8 and textile 5 smoothly follows the surface contour 21 of the framework 2, it may be preferred that the mesh 8 is rather stiff, and in this case, it may be especially advantageous when the part 32 of the textile 5 that is bent about the rounded outer edges 29 of the profile members 27, 28 is not laminated with the mesh 8, as otherwise, it could be difficult or even impossible to ensure that the textile 5 smoothly follows the rounded outer edges 29 of the profile members.

It is noted that preferably, firstly the mesh 8 is attached to the framework 2 by means of connectors 9 at suitable locations in order to make the mesh 8 and textile 5 smoothly follow the surface contour 21 of the framework 2, and secondly, the textile 5 is bent about the rounded outer edges 29 of the profile members 27, 28, and the edge part 32 of the textile 5 is fixed to the building-facing side 31 of the profile members 27, 28. Thereby, the dimensions of the mesh 8 and the textile 5 may be adapted to the framework 2 and the rounded outer edges 29 of the profile members 27, 28 during mounting of the mesh 8 and textile 5 on the framework 2, whereby correct dimensions may be ensured in an easy way.

LIST OF REFERENCE NUMBERS

1 building panel
2 framework
3 room-facing side of framework
4 building-facing side of framework
5 textile
6 first surface of textile
7 second surface of textile
8 mesh
9 connector
10 first end of connector
11 gripper of connector
12 part of mesh
13 second end of connector
14 tensioned spring
15 tension coil spring
16 adhesive
17 mesh opening
18 concave area of room-facing side of framework
19 beam of framework
20 beam of framework
21 surface contour formed by criss-crossed beams
22 laminate
23 fixation cutouts
24 connector cutout
25 edge of beam
26 frame
27 profile member
28 profile member
29 rounded outer edge of profile member
30 room-facing side of profile member
31 building-facing side of profile member
32 edge part of textile
33 border of mesh
34 first hook of tension coil spring
35 second hook of tension coil spring
36 roll of textile
37 roll of heat activated adhesive
38 roll of mesh
39 roll of finished laminate
40 pressure blanket
41 heating element
42 cooling element
43 roller for pressure blanket
44 slit of beam
45 remaining part of beam in the lateral direction
46 connection piece
47 locking tab
48 locking slit in beam
49 tapered part of locking tab
50 convex area of room-facing side of framework
51 serrated track
52 retaining member
53 tab of beam end
54 serrated track of profile member
55 lateral slit in profile member
56 rod formed from spring steal
57 partly open rounded channel
58 corner connection for profile members

The invention claimed is:

1. A building panel adapted to be mounted at a ceiling or wall of a room comprising:

a framework of the building panel having a room-facing side and a building-facing side;

a textile extended over the room-facing side of the framework, the textile having a first surface facing the framework and a second surface generally visible from said room; and a mesh laminated onto the first surface of the textile, wherein the mesh is attached to the framework by means of a number of connectors, and wherein each connector has a first end in the form of a gripper inserted between a part of the mesh and the textile and a second end attached to the framework.

2. The building panel according to claim 1, wherein the first and second ends of each connector are mutually connected by means of a tensioned spring.

3. The building panel according to claim 1, wherein each connector comprises a tension coil spring having a first hook forming the gripper at the first end of the connector, and having a second hook at the second end of the connector, and wherein the second hook is attached to the framework.

4. The building panel according to claim 1, wherein the mesh is formed from a resilient material.

5. The building panel according to claim 1, wherein a stiffness of the mesh is configured such that the second surface of the textile follows a surface contour of the framework.

6. The building panel according to claim 1, wherein the mesh includes mesh openings, wherein the mesh is laminated onto the first surface of the textile by means of an adhesive, and wherein the adhesive does not cover or covers only part of the textile covered by the mesh openings.

7. The building panel according to claim 1, wherein the mesh is laminated onto the first surface of the textile by means of heat lamination, and wherein a heat activated adhesive in the form of a slit film net or web is arranged between the mesh and the textile.

8. The building panel according to claim 1, wherein the room-facing side of the framework includes at least one concave area, and wherein, at each concave area of the room-facing side of the framework, the mesh is attached to the framework by means of at least one connector.

9. The building panel according to claim 1, wherein the framework includes a number of criss-crossed beams forming a surface contour followed by the laminate of the mesh and the textile.

10. The building panel according to claim 9, wherein each beam is provided with a number of fixation cutouts which are mutually spaced in a longitudinal direction of the beam and which the second end of one of the number of connectors may engage for connection with the beam.

11. The building panel according to claim 10, wherein at each fixation cutout, a connector cutout is formed in an edge of the beam, said edge supporting the laminate of the mesh and the textile, and wherein the connector cutout is adapted to receive one of the number of connectors attaching the mesh to the framework.

12. The building panel according to claim 1, wherein the framework is surrounded by a frame composed by profile members, wherein each profile member has a rounded outer edge connecting a room-facing side of the profile member with a building-facing side of the profile member, wherein the textile is bent about the rounded outer edges of the profile members, and wherein an edge part of the textile is fixed to the building-facing side of the profile members.

13. The building panel according to claim 12, wherein the edge part of the textile that is bent about the rounded outer edges of the profile members is not laminated with the mesh, so that a border of the mesh is located next to the room-facing side of the profile members.

14. A method of manufacturing a building panel adapted to be mounted at a ceiling or wall of a room comprising, extending a textile over a room-facing side of a framework of the building panel having a room-facing side and a building-facing side, the textile having a first surface facing the framework and a second surface generally visible from said room;

laminating a mesh onto the first surface of the textile before extending the textile over the room-facing side of the framework;

attaching, after extending the textile over the room-facing side of the framework, the mesh to the framework by means of a number of connectors, wherein each connector has a first end in the form of a gripper which is inserted between a part of the mesh and the textile and a second end which is attached to the framework.

15. The method of manufacturing a building panel according to claim 14, whereby the first and second ends of each connector are mutually connected by means of respective springs which are tensioned by the attachment of the mesh to the framework by means of the connectors.

16. The method of manufacturing a building panel according to claim 14, wherein the mesh includes mesh openings, and whereby the mesh is laminated onto the first surface of the textile by means of an adhesive so that the adhesive does not cover or covers only part of the textile being covered by the mesh openings.

17. The method of manufacturing a building panel according to claim 14, whereby the mesh is laminated onto the first surface of the textile by means of heat lamination, and whereby a heat activated adhesive in the form of a slit film net or web is arranged between the mesh and the textile.

18. The method of manufacturing a building panel according to claim 14, whereby the room-facing side of the framework includes at least one concave area, and whereby, at each concave area of the room-facing side of the framework, the mesh is attached to the framework by means of at least one of the numbers of connectors.

19. The method of manufacturing a building panel according to claim 14, whereby the framework includes a number of criss-crossed beams forming a surface contour to be followed by the laminate of the mesh and the textile, whereby for each beam of the number of criss-crossed beams, a number of fixation cutouts are provided which are mutually spaced in a longitudinal direction of the beam, and whereby for each beam of the number of criss-crossed beams, the second end of each connector is brought into engagement with a respective fixation cutout for connection with the beam.

20. The method of manufacturing a building panel according to claim 19, whereby at each fixation cutout, a connector cutout is formed in an edge of the beam, whereby the laminate of the mesh and the textile is arranged so that it is supported by said edge, and whereby each connector is arranged in a respective connector cutout in order to attach the mesh to the framework.

21. The method of manufacturing a building panel according to claim 14, whereby the framework is surrounded by a frame composed by profile members, whereby each profile member has a rounded outer edge connecting a room-facing side of the profile member with a building-facing side of the profile member, and whereby, after attaching the mesh to the framework by means of connectors, the textile is bent about the rounded outer edges of the profile members, and an edge part of the textile is fixed to the building-facing side of the profile members.

22. The method of manufacturing a building panel according to claim 21, whereby, before bending the textile about the rounded outer edges of the profile members, an edge part of the textile that has to be bent about said rounded outer edges is delaminated from the mesh, and the delaminated edge part of the mesh is cut off, so that a border of the mesh is located next to the room-facing side of the profile members, when the edge part of the textile has been bent about said rounded outer edges and has been fixed to the building-facing side of the profile members.

* * * * *